US009993671B2

(12) United States Patent
Huehn

(10) Patent No.: US 9,993,671 B2
(45) Date of Patent: Jun. 12, 2018

(54) FALL PROTECTION DEVICE

(71) Applicant: IVECO MAGIRUS AG, Ulm (DE)

(72) Inventor: Alexander Huehn, Ulm (DE)

(73) Assignee: IVECO MARGIRUS AG, Ulm, DE (US)

( * ) Notice: Subject to any disclaimer, the term of this patent is extended or adjusted under 35 U.S.C. 154(b) by 0 days. days.

(21) Appl. No.: 15/088,316

(22) Filed: Apr. 1, 2016

(65) Prior Publication Data

US 2016/0287918 A1 Oct. 6, 2016

(30) Foreign Application Priority Data

Apr. 3, 2015 (EP) ..... 15248049

(51) Int. Cl.

| | |
|---|---|
| ***A62B 35/00*** | (2006.01) |
| ***A62B 1/08*** | (2006.01) |
| ***A62C 27/00*** | (2006.01) |
| ***B66F 17/00*** | (2006.01) |
| *B66F 11/00* | (2006.01) |
| *B66F 11/04* | (2006.01) |

(52) U.S. Cl.

CPC ..... *A62B 35/0093* (2013.01); *A62B 1/08* (2013.01); *A62B 35/005* (2013.01); *A62C 27/00* (2013.01); *B66F 17/006* (2013.01); *B66F 11/00* (2013.01); *B66F 11/04* (2013.01)

(58) Field of Classification Search

CPC . A62B 35/0093; A62C 27/00; A63B 69/0048; A63B 69/0064; B66F 11/00; B66F 11/04

See application file for complete search history.

(56) References Cited

U.S. PATENT DOCUMENTS

| | | | | |
|---|---|---|---|---|
| 4,007,793 | A * | 2/1977 | Hux | A62C 31/24 169/25 |
| 4,705,140 | A * | 11/1987 | Dudley | A62B 1/02 182/113 |
| 6,092,911 | A | 7/2000 | Baker et al. | |
| 6,148,580 | A * | 11/2000 | Weir | A62B 35/0056 182/3 |
| 6,467,576 | B2 * | 10/2002 | Figura | E06C 5/04 182/2.5 |
| 6,755,258 | B1 * | 6/2004 | Hunke | A62C 27/00 169/24 |
| 7,740,106 | B2 * | 6/2010 | Vetesnik | A62B 1/04 182/116 |
| 7,766,090 | B2 * | 8/2010 | Mohr | A62C 3/02 169/12 |

(Continued)

FOREIGN PATENT DOCUMENTS

| | | |
|---|---|---|
| DE | 7919497 U | 11/1979 |
| JP | 2008068943 A | 3/2008 |
| JP | 2012162338 A | 8/2012 |

OTHER PUBLICATIONS

European Search Report for EP Application No. 15248049.7 dated Sep. 18, 2015, 6 pages.

*Primary Examiner* — Colleen M Chavchavadze
(74) *Attorney, Agent, or Firm* — RMCK Law Group, PLC

(57) ABSTRACT

A fall protection device, characterized by a module (12) with an adapter (16) for detachably attaching the module (22) at the tip of an aerial apparatus, the module comprising a plurality of ropes (36), each rope extending from an individual fall arresting device received within the module.

14 Claims, 3 Drawing Sheets

(56) References Cited

U.S. PATENT DOCUMENTS

| | | | | |
|---|---|---|---|---|
| 7,828,116 | B2 * | 11/2010 | Vetesnik | A62B 1/04 182/115 |
| 9,623,270 | B2 * | 4/2017 | Palet | E04G 21/3204 |
| 2005/0034920 | A1 * | 2/2005 | Anderson | A62B 1/04 182/3 |
| 2008/0060822 | A1 * | 3/2008 | Salmi | A62C 27/00 169/24 |
| 2015/0027808 | A1 | 1/2015 | Baillargeon et al. | |
| 2016/0287918 | A1 * | 10/2016 | Huehn | A62B 35/005 |

* cited by examiner

FALL PROTECTION DEVICE

CROSS REFERENCE TO RELATED APPLICATIONS

This application claims priority to European Patent Application No. 15248049.7 filed on Apr. 3, 2015, the entire disclosure of which is incorporated herein by reference.

FIELD OF THE INVENTION

The present invention is related to a fall protection device.

BACKGROUND OF THE INVENTION

A fall protection device is known as a personal safety system for persons working in great height, such as workers or members of a rescue staff. The person is secured by a personal fall arrest, such as a lifeline or rope connecting the body wear of the person to be secured, like a full body harness, with a securing point. It is essential to absorb the energy within the system to prevent the person from being injured in the case of falling. For this reason different kinds of shock absorbers can be integrated within the fall protection device, such as stretching ropes to lengthen the fall distance such that the rope absorbs energy, or shock absorbing rope brakes, etc.

To secure members of a rescue staff in rescue situations, a main problem is that there is usually no predetermined securing point for such a fall protection device. For example, if the rescue site is the front of a common building, a roof or the like, there is often no opportunity to fasten a securing rope or no time to look for a suitable locking point. An additional problem is to secure a plurality of persons in a rescue situation in great height at a place with no predetermined securing point.

SUMMARY OF THE INVENTION

It is therefore an object of the present invention to provide a fall protection device for securing persons at places in great height with no suitable securing point in the area of use to attach the end of the securing rope. Moreover, this fall protection device should also be suitable to secure more than one person at the same time individually.

This object is achieved by a fall protection device comprising the features of claim 1.

The fall protection device according to the present invention comprises a module with an adapter for detachably attaching a module at the tip of an aerial apparatus. One example for such an aerial apparatus is a turnable telescopic ladder of a firefighting vehicle. To prepare a fall protection device for use, the module is attached by suitable attaching means at the tip of the aerial apparatus such that it can be lifted and positioned over the area in which the rescue worker to be secured will be positioned. The module comprises a plurality of ropes, each rope extending from an individual fall arresting device received within the module.

Because of the arrangement of the module at the tip of the aerial apparatus, there is a great freedom to position the fall protection device such that the secured person can move freely within a large area. If more than one person is to be secured, these persons can move individually and be protected at the same time by the same fall protection device.

Because such an aerial apparatus, like a turnable ladder on top of the firefighting vehicle, can be positioned at any place where needed, the fall protection device according to the present invention is not bound to any predetermined and fixed locking points to secure the end of a securing rope.

According to a preferred embodiment of the present invention, each fall arresting device comprises a reel block to wind up the respective rope. This individual reel block can be set the rope under a certain tension against its extension direction, such that the rope can be extended with low pulling force without obstructing a free movement of the person fixed at the end of the rope, but exerting enough tension to prevent a rope from sagging within the space between the person and the module. If the secured person approaches the module, the tension on the wheel block winds up the rope to shorten the length of the rope and to prevent sagging.

On the other hand, if the person moves away from the module, this movement is possible against the slight tension of the reel block so as not to obstruct this movement, as described above.

Preferably each reel block comprises a rope brake. Such a rope brake does not obstruct the free running of the reel block at low extension speed of the rope. However, if the rope speed is increased over a predetermined level, for example, if the secured person is falling, the rope brake stops the rope immediately to prevent the rope from further being wound further from the reel block.

More preferably, the reel blocks are arranged next to each other with their reel axis aligned on a common horizontal axis.

According to another preferred embodiment, the module comprises a housing in which the reel blocks are received.

According to another preferred embodiment of the present invention, the module comprises at least one supply line provided as a cable or hose extending from a reel to be extracted from the module. This supply line may be, for example, a hose for supplying pressurized air, respiratory air, a hydraulic fluid for driving and controlling a hydraulic apparatus, water for firefighting, foam, powder or any other fire extinguishing agent, or a cable for supplying electric power.

More preferably, the reel for the supply line is laterally attached to the housing or the adapter.

According to another preferred embodiment of the present invention, the module comprises a lighting device. Such a lighting device might be a spotlight for illuminating the area in which the secured person is moving.

Preferably, such a lighting device is laterally attached to the housing or to the adapter.

According to another preferred embodiment, the fall protection device according to the present invention comprises load sensors for determining the load status of each rope, and transmission means for transmitting data representing the individual load status of each rope to the aerial apparatus. These data can be used to control the aerial apparatus depending on the load status, in particular depending on the number of ropes that are used to secure persons thereon, and to calculate extension or movement limits of the aerial apparatus. It is possible to use common load sensors for measuring the precise weight or load acting on each rope, but it is also possible to use simple contact sensors at the housing to determine whether an individual rope is extended or not, i. e. determining the state of use or non-use.

More preferably, the fall protection device comprises rope state sensors for monitoring lateral forces acting on the individual ropes and/or their respective fall arresting devices. Such lateral forces are those which do not act in a direction exactly perpendicular to the rear axis around.

Which the ropes are wound up. If these lateral forces exceed certain limits, a warning signal may be generated to be perceived by the operator of the fall protection device.

More preferably, the fall protection device according to the present invention comprises contact detection means for detecting a contact between different ropes. Such contact detection means may generate a low electric voltage to different ropes, and in case the ropes have contact, a current workflow through these ropes might be detected. If this is the case, a warning signal may be generated for the operator.

The invention is further related to an aerial apparatus, comprising a fall protection device of the above kind that is detachably attached to the tip of the aerial apparatus.

Preferably, this aerial apparatus is a telescopic turnable ladder of a firefighting vehicle.

According to one preferred embodiment of the present invention, the fall protection device comprises an identification means, and the aerial apparatus comprises a controller for identifying the identification means via an interface between the aerial apparatus and the fall protection device.

According to another preferred embodiment of this aerial apparatus, the controller comprises a receiver for receiving data representing the individual load status of each rope transmitted by the transmission means of the fall protection device, and the controller is provided to calculate extension limits of the aerial apparatus on the basis of each data.

BRIEF DESCRIPTION OF THE DRAWINGS

These and other aspects of the invention will be apparent from and elucidated with reference to embodiments of the present invention described in the following figures.

DETAILED DESCRIPTION OF THE INVENTION

Figure 1:
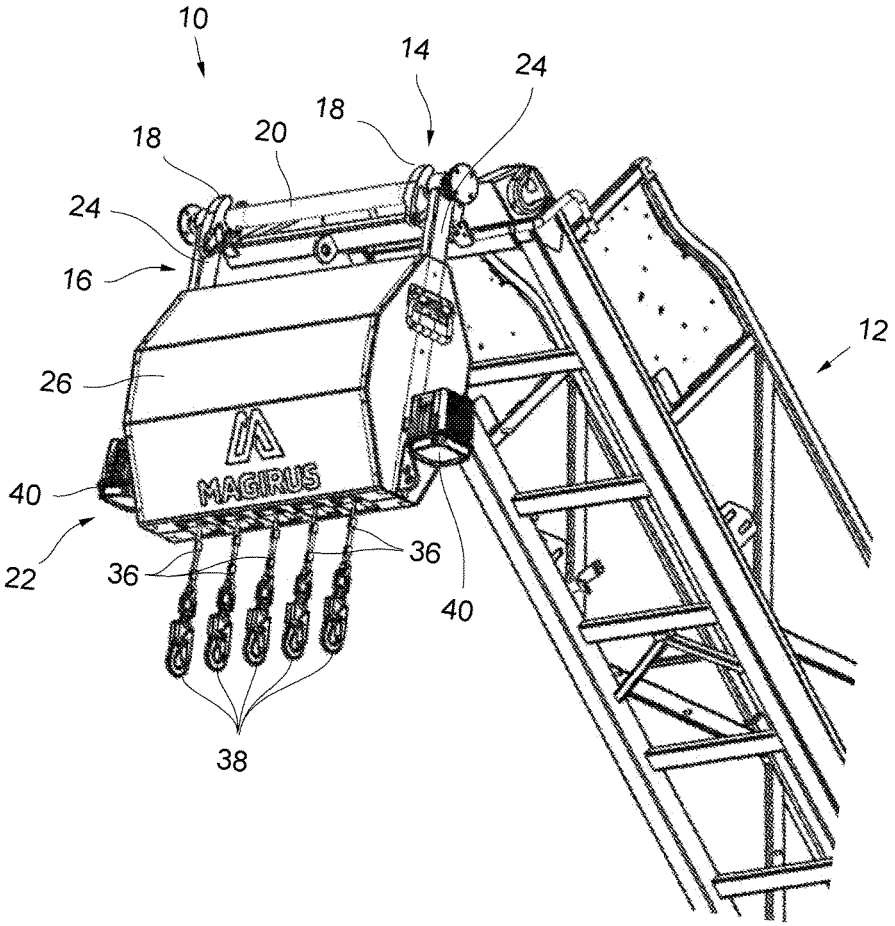
FIG. 1 is a perspective view of one embodiment of a fall protection device according to the present invention, which is attached to the tip of a turnable ladder as one example of an aerial apparatus.

The fall protection device 10 shown in FIG. 1 is attached to the tip of a telescopic turnable ladder 12 of a firefighting vehicle (not shown). The turnable ladder 12 is shown in an partially erected state. At the tip of the turnable ladder 12, a reception 14 for an adapter 16 of the fall protection device 10 is provided. This reception 14 comprises two hooks 18 that are opened in an upward direction to receive a horizontal bar 20 which is part of the adapter 16. The bar 20 is received at its two opposite ends within the left and right hook 16,18 of the reception 14.

Figure 2:
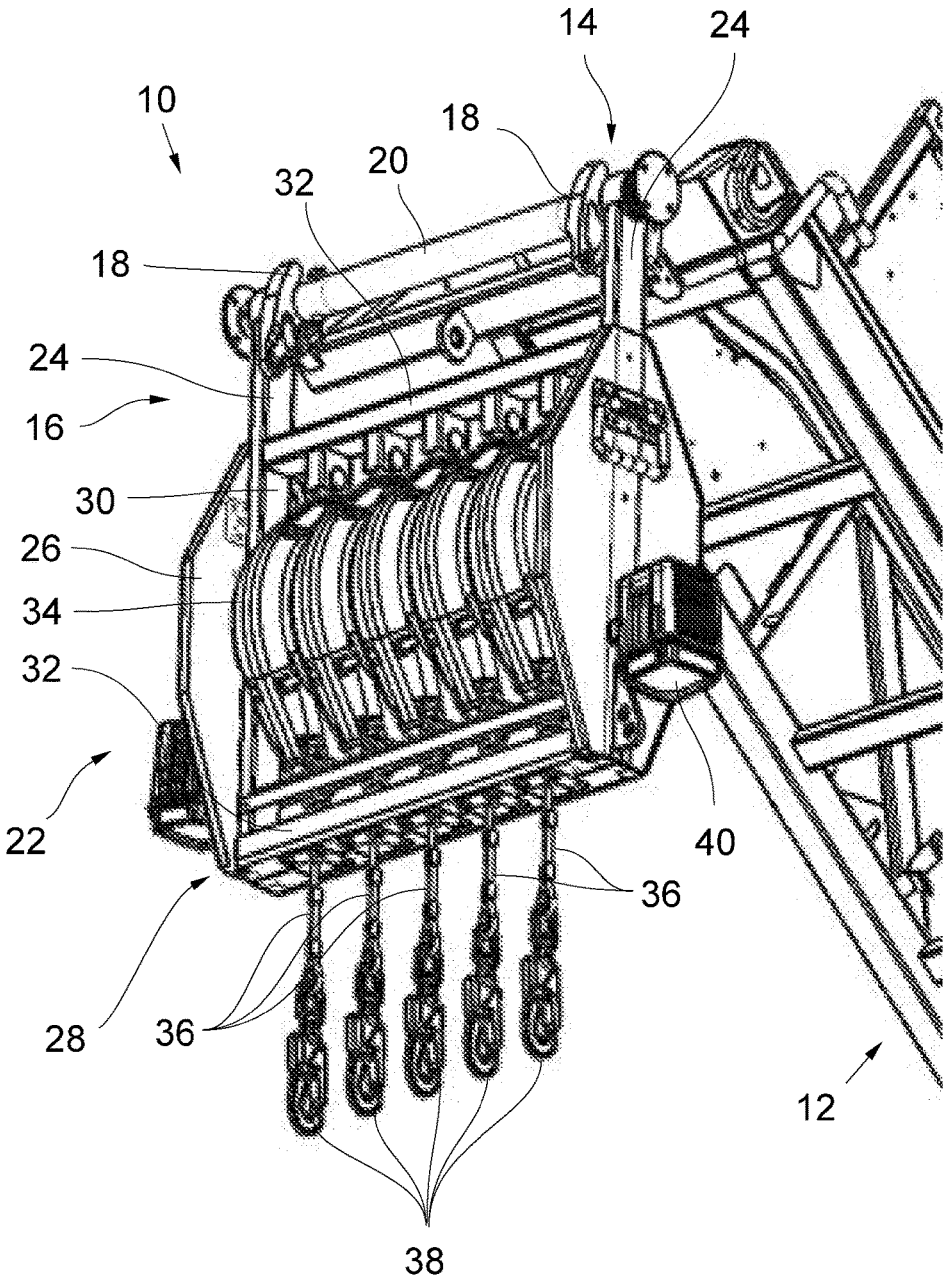
FIG. 2 shows the embodiment of the fall protection device of FIG. 1 in an opened state.

The adapter 16 is mounted on top of a module 22, with two vertical beams 24 extending at each side of the module 22 in an upward direction, and the bar 20 being mounted on top of the vertical beams 24. The module 22 receives a plurality of individual fall arresting devices comprising reel blocks, as shown in FIG. 2. It comprises a housing 26 in which a rectangular frame 28 is mounted. It can be taken from FIG. 2 that the vertical beams 24 that extend from the upper side from the housing 26 represent the upper sections of vertical frame parts 30 which extend over the complete height of the module 22. The upper and lower ends of the vertical frame parts 30 are connected by horizontal frame parts 32, to complete the frame 28.

Within the frame 28, a plurality of reel blocks 34 is disposed as fall arresting devices that are arranged next to each other hanging from the upper horizontal frame part 32. The reel blocks 34 as such are identical. From each reel block 34, a rope 36 extends to the guided out of the module 22 in a downward direction. At the free end of each rope 36, a carabiner 38 is fixed as an attaching means for a personal body harness (not shown). By means of the carabiners 38, each one person can be secured to the end of each rope 36.

Each rope 36 can be pulled in the vertical downward direction from its reel block 34 out of the module 22. Within each reel block 34, a rope brake (not shown) is provided such that the rope 36 can be pulled out of its reel block 34 at a relatively low speed. If a predetermined speed level is exceeded, the rope brake blocks the running movement of the rope, such that a further rope extension is prevented. This predetermined blocking speed level is adjusted such that it is below the speed of the falling person. Below this speed level, the person secured at the end of the rope 36 can extract the rope 36 freely from the module 22 with low force, without being obstructed in her/his movement.

In the present embodiment, five ropes 36 are present to be extracted from five reel blocks 34, respectively, such that five persons can be secured individually by the present fall protection device 10.

Although not shown in this embodiment, it is possible to provide further shock absorbing means in the arrangement of the rope 36. For example, at least one section of the rope 36 can be stretched to absorb the energy of a person when falling, to prevent injuries.

It can also be taken from FIG. 2 that the reel blocks 34 are arranged next to each other with their reel axes being aligned on a common horizontal axis.

The module 22 can easily be attached to the tip of the turnable ladder 12 by putting the bar 20 of the adapter 16 into the hooks 18 of the reception 14. If the fall protection device 10 is not needed further, it can simply be detached from the tip of the turnable ladder 12 by taking the bar 20 off from the hooks 18.

At the opposite sides of the housing 26, lighting devices 40 are mounted to illuminate the area below the module 12. In the present embodiment, the lighting devices 40 are spotlights with LED (light emitting diode) illuminants. Each of the two opposite spotlights may be directed in a slightly different angle. In the present embodiment, the lighting devices 40 are modules attached laterally to the housing 26. However, according to a different embodiment, the lighting devices 40 can be integrated into the housing 26 of the module 22.

Figure 3:
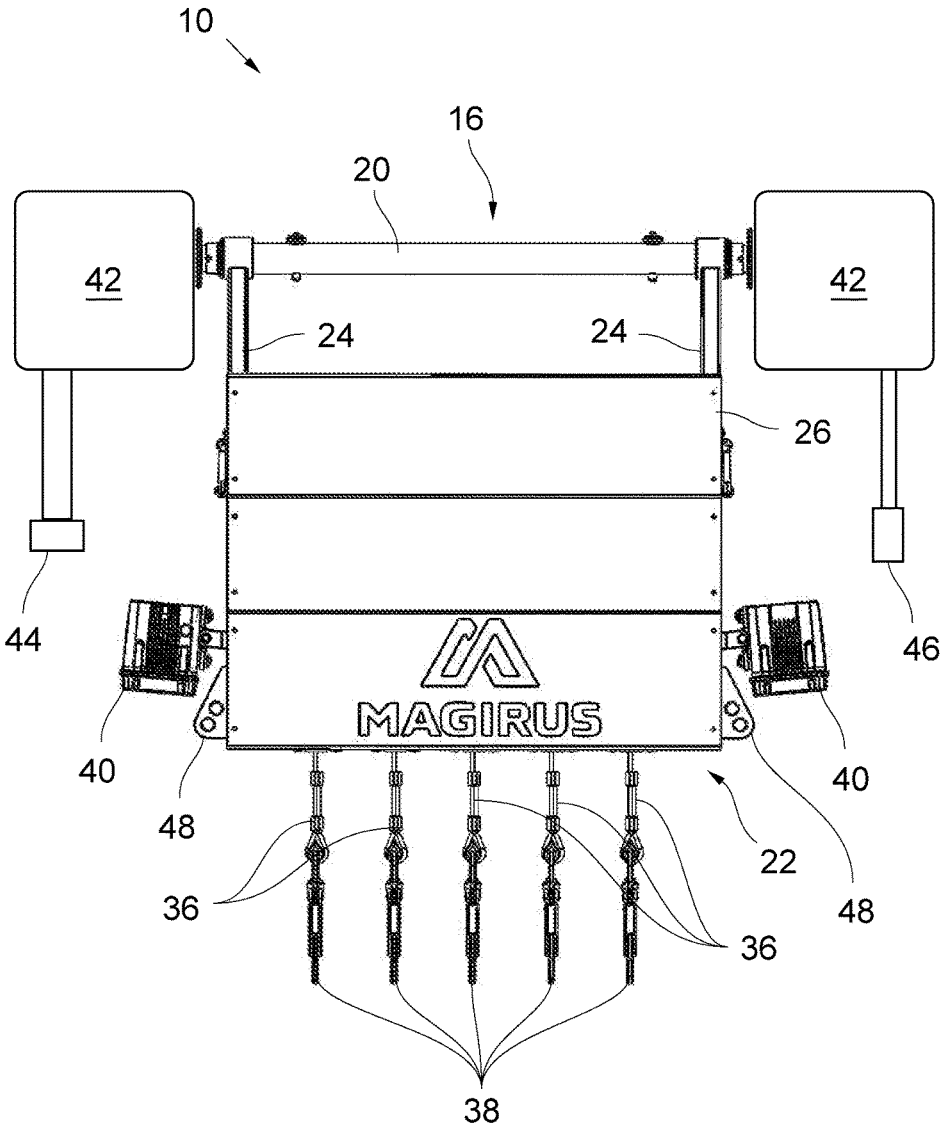
FIG. 3 is a schematic front view of the fall protection device of FIGS. 1 and 2, with the positions of supply line reels laterally attached to the adapter of the fall protection device.

As shown in FIG. 3, there is also the option to attach supply devices 42 laterally to the fall protection device 10, for the purpose to supply air, water, fire extinguishing agent, electric power or the like to the person secured by the fall protection device 10. Each supply device 42, as schematically shown in FIG. 3, comprises a reel on which a supply line is wound. In the present embodiment, on the left side of the adapter 16 of the fall protection device 10, a supply device 42 is mounted that comprises a reel on which a hose 44 is wound. The hose 44 can be unwound from the reel to be guided towards the end of one of the ropes 36. The total length of the hose 44 should be adapted accordingly. The hose 44 may be provided to supply pressurized air, respiration air, a hydraulic fluid, water, in particular water for firefighting, any other firefighting agent (as liquid, foam, powder, or the like).

The opposite supply device 42 is attached to the opposite end of the bar 20 and comprises a reel on which an electric cable 46 is wound. This electric power cable 46 can be unwound from its reel inside the supply device 42 such as to be guided towards the end of one of the ropes 36. It is used to supply electric energy to any device that might be needed in a rescue operation.

Any of the supply devices 42 mounted to the opposite sides of the adapter 16 can be replaced against a supply device of another kind, for another supply purpose. It is also possible to replace one of the supply devices 42 by a rope winch. It is further possible to attach the supply device 42 not laterally to the adapter 16 but to the housing 26, as it is the case with the lighting devices 40 in the present embodiment.

Below the lighting devices 40, additional attachment means 48 are mounted at opposite sides of the housing 26. These attachment means 48 comprise eyes, i. e. openings for attaching a hook or the like. With these attachment means 48, it is possible to attach the upper end of an additional rope to a fall protection device 10.

The fall protection device 10 can also be equipped with an identification means to automatically identify the presence of the fall protection device 10 by a controller of the turnable ladder 12 via an interface at the tip of the turnable ladder 12. This recognition can be important for setting the right parameters for ladder control, because the kinematic behavior of the ladder system is different with the rescue cage at the tip of the turnable ladder 12 being replaced by the fall protection device 10 according to the present embodiment.

Moreover, the fall protection device 10 can be equipped with different kind of sensors for determining the load status or forces acting on the individual ropes. For example, load sensors can be provided at each rope 36 for determining the load status, i. e. for determination whether the rope is used for securing a person or not, and/or for determining the precise load acting on this rope 36. Data representing the individual load status of each rope 36 can be transmitted to a controller of the turnable ladder 12 and used for calculating the extension limits of the turnable ladder 12 depending on the load, so that an overload with reference to the present extension status of the ladder can be prevented, or the limits of the extension of the turnable ladder 12 can be adapted to the present load status. Such load sensors can also be represented by contact sensors at the housing 26 for detecting a contact of a carabiner 38 at the end of a rope 36 to the housing 26, indicating that this rope 36 is not used.

Moreover, rope state sensors can be provided at the fall protection device 10 for monitoring lateral forces acting on the individual rope 36 and/or their fall arresting devices. Such lateral forces are those which do not act perpendicular to the rear axis of the rear blocks 34. If these lateral forces exceed certain limits, a warning signal may be generated that is perceivable by an operator.

Furthermore, contact detection means can be provided for detecting a contact between different ropes 36. For example, a low electric voltage can be applied to different ropes 36 such that a current may flow between contacting ropes 36, indicating the contact. A detection signal or warning signal may also be generated in this case.

The invention claimed is:

1. A fall protection device (10), comprising:

a module (22) with an adapter (16) for detachably attaching the module (22) at a tip of an aerial apparatus, said module (22) comprising:

a plurality of ropes (36), each rope (36) extending from an individual fall arresting device received within the module (22), and at least one supply line (44, 46) provided as a cable or hose extending from a reel to be extracted from the adapter (16), the at least one supply line configured for dispensing fluid or electricity to a user of the fall protection device;

wherein each fall arresting device includes a reel block (34) to wind up the respective rope (36), and the module (22) comprises a housing (26) in which the reel blocks (34) are received.

2. The fall protection device according to claim 1, characterized in that each reel block (34) comprises a rope brake.

3. The fall protection device according to claim 1, characterized in that the reel blocks (34) are arranged next to each other with their reel axes aligned on a common horizontal axis.

4. The fall protection device according to claim 1, characterized in that the at least one supply line (44, 46) is configured to be unwound from its reel so as to be guided to an end of one of the plurality of ropes extending from the individual fall arresting device that is being utilized by the user.

5. The fall protection device according to claim 1, characterized in that the reel of the supply line (44, 46) is laterally attached to the housing (26).

6. The fall protection device according to claim 1, characterized in that the module (22) comprises a lighting device (40).

7. The fall protection device according to claim 6, characterized in that the lighting device (40) is laterally attached to the housing (26) or to the adapter (16).

8. A fall protection device comprising:

a module (22) with an adapter (16) for detachably attaching the module (22) at a tip of an aerial apparatus, said module (22) including:

a plurality of ropes (36), each rope (36) extending from an individual fall arresting device received within the module (22), at least one supply line (44, 46) provided as a cable or hose extending from a reel to be extracted from the adapter (2216), the at least one supply line configured for dispensing fluid or electricity to a user of the fall protection device, load sensors operably associated with the plurality of ropes, the load sensors configured to determine the load status of each rope (36), and transmission means operably associated with the load sensors, the transmission means configured to transmit data representing the individual load status of each rope (36) of the plurality of ropes to the aerial apparatus.

9. A fall protection device, comprising:

a module (22) with an adapter (16) for detachably attaching the module (22) at a tip of an aerial apparatus, said module (22) including:

a plurality of ropes (36), each rope (36) extending from an individual fall arresting device received within the module (22), at least one supply line (44, 46) provided as a cable or hose extending from a reel to be extracted from the adapter (16), the at least one supply line configured for dispensing fluid or electricity to a user of the fall protection device, and rope state sensors operably associated with the plurality of ropes, the rope state sensors configured to monitor lateral forces acting on individual ropes (36) of the plurality of ropes and/or their respective fall arresting devices.

10. The fall protection device according to claim 9, characterized by contact detection means associated with the module and operably associated with the plurality of ropes, the rope state sensors configured to detect a contact between different ropes (36) of the plurality of ropes.

11. An aerial apparatus, comprising a fall protection device (10) according to claim 1 that is detachably attached to the tip of the aerial apparatus.

12. The aerial apparatus according to claim 11, characterized in that the aerial apparatus is a telescopic turnable ladder (12) of a firefighting vehicle.

13. The aerial apparatus according to claim 11, characterized in that the fall protection device (10) comprises an identification means, and the aerial apparatus comprises a controller for identifying the identification means via an interface between the aerial apparatus and the fall protection device (10).

14. The aerial apparatus according to claim 13, characterized in that the controller comprises a receiver for receiving data representing the individual load status of each rope (36) transmitted by the transmission means of the fall protection device (10), wherein the controller is provided to calculate extension limits of the aerial apparatus on the basis of these data.

* * * * *